United States Patent [19]

Crawshay

[11] 4,155,409

[45] May 22, 1979

[54] ROD PULLER FOR ROCK DRILL

[75] Inventor: Richard Crawshay, Vancouver, Canada

[73] Assignee: Canadian Mine Services Ltd., Vancouver, Canada

[21] Appl. No.: 856,854

[22] Filed: Dec. 2, 1977

[51] Int. Cl.[2] ..... E21C 1/02; E21C 5/00

[52] U.S. Cl. ..... 173/29; 173/46

[58] Field of Search ..... 173/29, 46; 175/52, 175/85

[56] References Cited

U.S. PATENT DOCUMENTS

| | | | |
|---|---|---|---|
| 1,024,173 | 4/1912 | Betts | 173/29 |
| 2,433,477 | 12/1947 | O'Quinn et al. | 254/29 |
| 3,305,151 | 2/1967 | Cryderman | 226/181 |
| 3,871,618 | 3/1975 | Funk | 254/30 |

*Primary Examiner*—Lawrence J. Staab
*Attorney, Agent, or Firm*—Carver and Company

[57] ABSTRACT

Reversible puller for quickly pulling drill rods from, or for re-inserting drill rods into, drill hole. Rock drill has drill head mounted on feed carriage, drill head including rod rotating structure for rotating drill rod when in drilling mode. Rod puller includes drive wheel and idler wheel mounted for rotation with peripheries adapted for engagement with drill rod. Drive wheel is coaxial with, and rotates with, rod rotating structure and idler wheel cooperates with drill head for movement relative to drive wheel to permit idler wheel to be positioned so as to be essentially coplanar with drive wheel with wheel axes parallel. Drill head is swivellably mounted on carriage to permit drill head to be positioned in rod pulling mode wherein wheel axes are disposed generally normally to drill rod axis and periphery of drive wheel is spaced closely adjacent drill rod. Idler wheel is moved so that drill rod is squeezed between idler and drive wheels for moving rod in desired direction.

10 Claims, 8 Drawing Figures

ROD PULLER FOR ROCK DRILL

BACKGROUND OF THE INVENTION

1. Field of the Invention

The invention relates to a drill rod pulling attachment for use with a rock or earth drilling machine, in particular a diamond drilling machine.

2. Prior Art

In a normal drilling operation, it is desirable to be able to pull the drill rods from the drill hole for bit change, core recovery, etc., and to replace them in the hole again in as little time as possible. A drilling machine has a feed mechanism normally used for feeding the drill rods in a forward direction whilst actually drilling and, with the rotary drive thereof inactive and feed direction reversed, the feed mechanism can also be used for withdrawing the drill rods from the hole, and in the forward feed direction for re-inserting the rods into the hole. When the feed mechanism that is usually used for drilling is used for the rod withdrawing and re-insertion operations, it is usually relatively slow as the feed mechanism for drilling is necessarily limited in its rate of feed and also the relatively short stroke of the feed mechanism. To reduce the time required for the above withdrawing and re-insertion operations it would be desirable to move the rods in an essentially continuous motion limited only by the available length of tail room or clear space in which the rod can move axially, and not by the relatively short stroke of the feed mechanism as is the common situation.

Essentially continuous rod pulling devices are known in which two wheels or rollers grip a drill rod, at least one of the wheels being powered for moving the rod axially. These pulling devices usually require a separate motor for powering at least one of the wheels, and this increases the complexity and overall size of the drilling machine and can restrict its convenience of operation particularly when operating underground. Two main types of drilling machines are in common use and the present invention to be described could be adapted to operate with some examples of either type. The first type is a top drive drilling machine which is relatively simple and rotates the drill rods by means of a rotating male portion which engages a complementary female portion at a rear end of the drill rod. The second type is a chuck drive machine in which a manual or remotely operated chuck grips the drill rods and is mounted on a powered hollow spindle, the drill rods passing through the spindle. In the specification and claims either structure for rotating the drill rod is referred to as rod rotating means, and the terms rod "puller," "pulling" or like terms refers to axial displacement of the drill rod in either direction.

SUMMARY OF THE INVENTION

The present invention reduces some of the difficulties and disadvantages of the prior art by providing a rod pulling mechanism using two wheels, one of which is powered directly by the rod rotating means of the diamond drill head thus utilizing existing driving and support means so as to reduce size and complexity of the drilling machine.

A rod pulling mechanism according to the invention is for use with a drill head mounted on a drilling machine, in which the drill head includes a rod rotating means having a main axis and being adapted for holding and rotating a drill rod about a drill rod axis for drilling a hole when in a drilling mode. The rod pulling mechanism includes a drive wheel, an idler wheel and a swivellable mounting means. The drive wheel is mounted for rotation with the rotating means about a drive wheel axis coincident with the main axis and has a periphery adapted for driving engagement with the drill rod. The idler wheel is mounted for rotation about an idler wheel axis and has a periphery adapted for engagement with the drill rod. The idler wheel cooperates with the drill head for movement relative to the drill wheel to permit the idler wheel to be positioned in a rod pulling mode so as to be essentially coplanar with the drive wheel with the idler wheel axis disposed parallel to the drive wheel axis. The swivellable mounting means connects the drill head to the drilling machine to permit the drill head to be positioned in a rod pulling mode in which the drive wheel axis is disposed generally normally to the drill rod axis, and the periphery of the drive wheel is spaced closely adjacent the drill rod. When in the rod pulling mode the idler wheel can be moved to a position in which oppositely disposed peripheries of the drive wheel and idler wheel become spaced generally equally on opposite sides of the drill rod axis so as to accept and grip a drill rod therebetween.

A detailed disclosure following, relating to the drawings, describes a preferred embodiment of the invention which is capable of expression in structure other than that particularly described and illustrated.

DETAILED DISCLOSURE

FIG. 1

Figure 1:
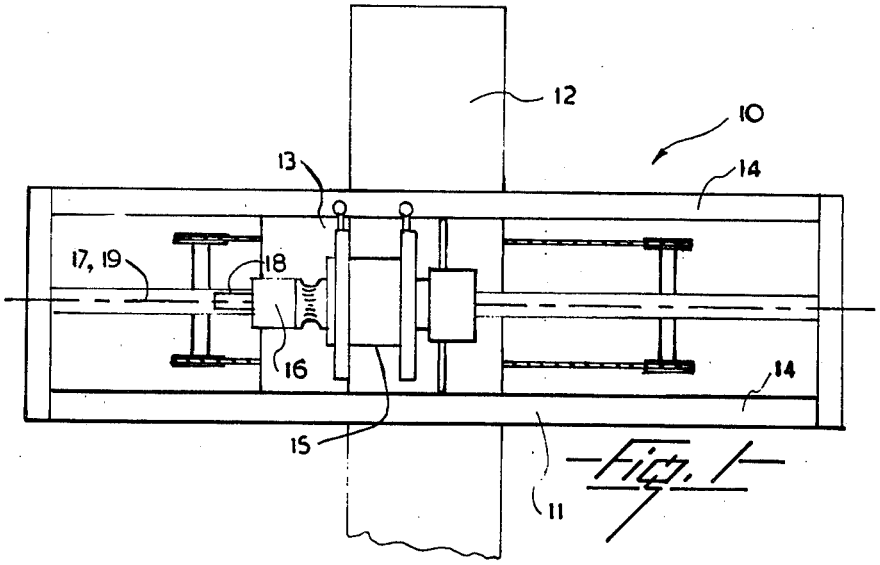
FIG. 1 is a simplified fragmented side elevation of a portion of a drilling machine showing major components thereof, the machine being fitted with a rod pulling mechanism according to the invention, the machine being shown in a drilling mode.

A drilling machine 10 has a feed frame 11 mounted on a post 12 which can be carried on a vehicle, not shown. The frame 11 has a pair of spaced rails 14 carrying a feed carriage 13 which can be traversed in either direction along the feed frame. A drill head 15 is carried on the carriage and has a rod rotating means 16 having a main axis 17. In a drilling mode as shown, the means 16 is adapted for holding and rotating a drill rod 18 about a drill rod axis 19 concurrently whilst the drill head is fed along the feed frame by traversing the carriage forwardly along the feed frame. In the drilling mode the main axis 17 and the drill rod axis 19 are coincident.

FIGS. 2 through 5

The drill head 15 includes a rod pulling mechanism 22 according to the invention which includes a drive wheel 24 mounted for rotation with the rotating means 16 about a drive wheel axis 25 coincident with the main axis 17. The drive wheel has a periphery 27 which is concave in cross-section as shown and is generally complementary to an outer surface of the drill rod and preferably is fitted with rod engaging means such as serrations or carbide teeth and thus is adapted for driving engagement with the drill rod. The drive wheel is disposed symmetrically about a wheel central plane 28 which is disposed normally to the axes 17 and 25. The drive wheel has a minimum radius 29 which defines a central periphery 31 of the wheel and is disposed within the wheel central plane 28. A water swivel connection 30 cooperates with the rod rotating means 16 and supplies water to the drill rods, as is common practice.

Figure 4:
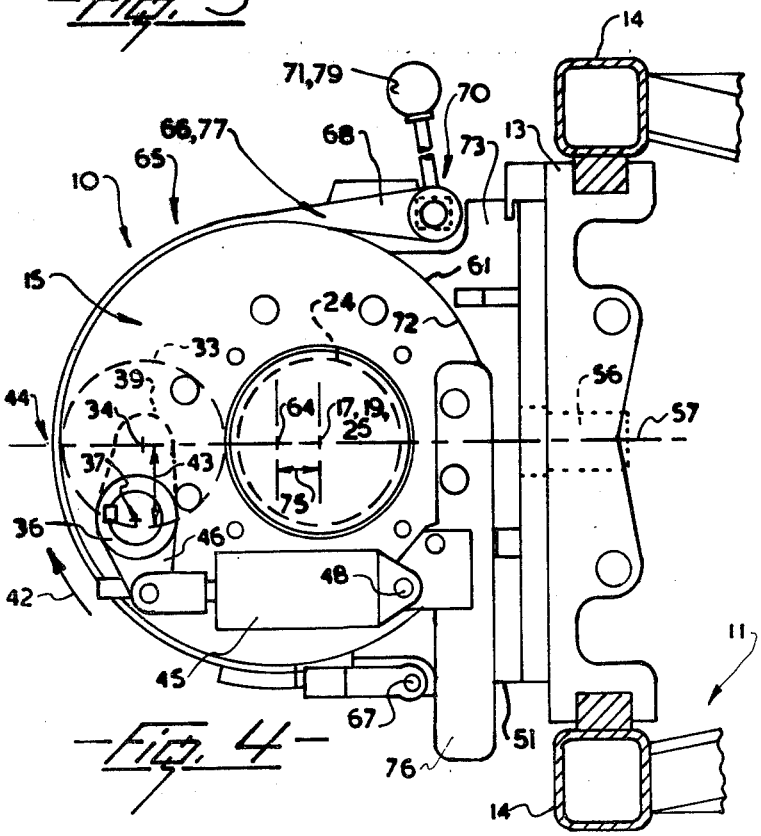
FIG. 4 is a simplified fragmented end elevation of the drill head as seen from Line 4—4 of FIG. 3.

The rod pulling mechanism 22 further includes an idler wheel 33 mounted for rotation about an idler wheel axis 34 disposed parallel to the drive wheel axis 25, the idler wheel being disposed symmetrically about the wheel central plane 28 so as to be coplanar with the drive wheel. An idler shaft 36 having an idler shaft axis 37 is journalled for rotation relative to the drill head about the idler shaft axis and is carried in idler shaft journals 40 and 41. An idler arm 39 extending from the shaft 36 carries the idler wheel so that the idler wheel axis 34 is disposed parallel to and displaced laterally from the idler shaft axis 37 by an axis spacing 43 so that the idler wheel is mounted eccentrically relative to the idler shaft. As can be seen in FIG. 4, rotation of the idler shaft in direction of an arrow 42 moves the idler wheel laterally towards the driven wheels as will be described, the idler wheel having a periphery adapted to engage the drill rod. Thus the displacement of the idler wheel axis from the idler shaft axis provides an eccentric mounting means 44 for the idler wheel characterized by the idler wheel being mounted for lateral movement relative to the drive wheel so that actuation of the eccentric mounting means engages or disengages the rod pulling mechanism 22 from the drill rods. An idler shaft actuating cylinder 45 extends between a crank arm 46 extending from the idler shaft and a cylinder mounting pin 48 secured to a portion of the drill head, so that actuation of the cylinder 45 swings the arm and moves the idler wheel laterally to actuate the eccentric mounting means.

Figure 3:
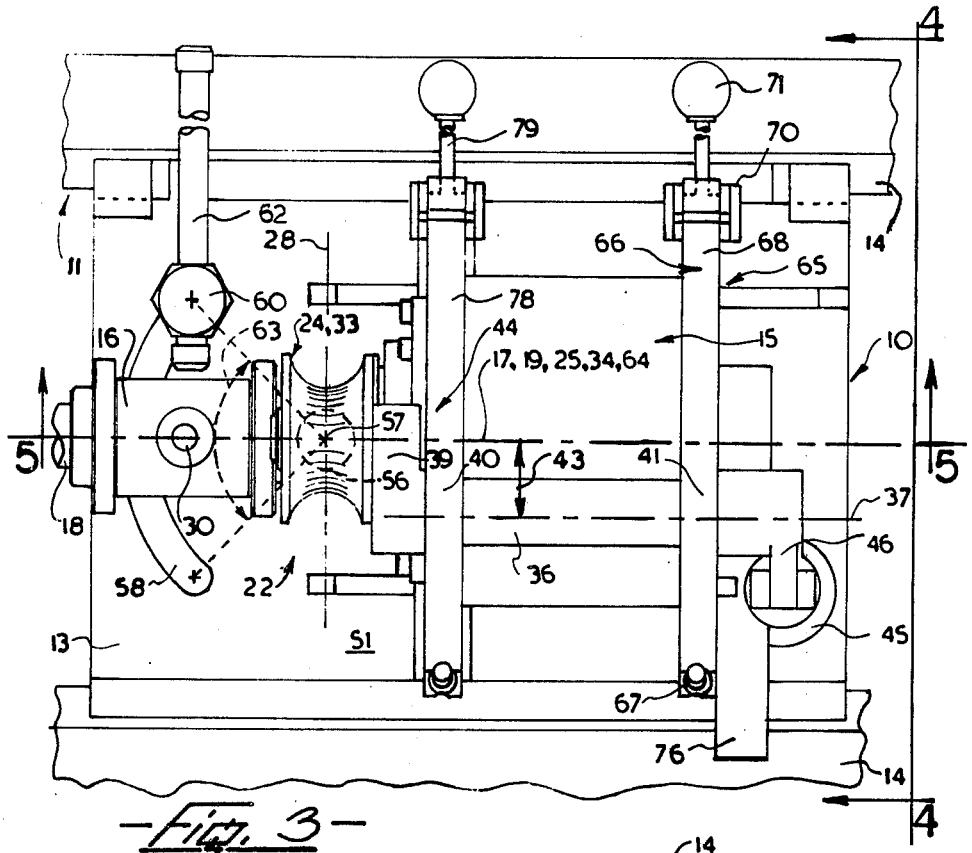
FIG. 3 is a simplified fragmented side elevation of the drill head as shown in FIG. 2.
Figure 5:
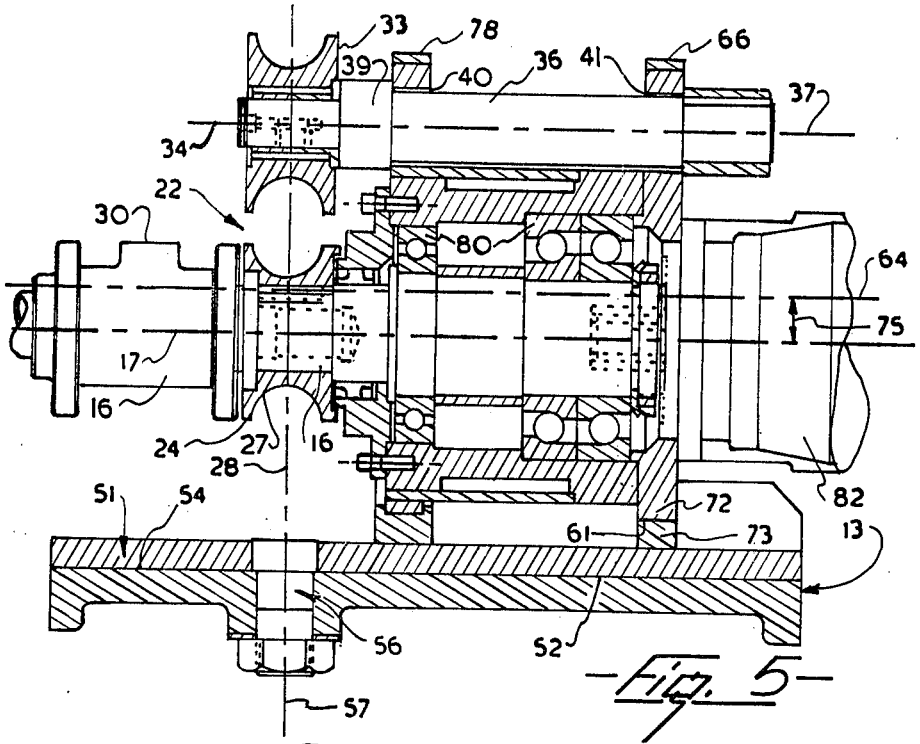
FIG. 5 is a simplified fragmented section of the drill head on Line 5—5 of FIG. 3.

As best seen in FIG. 5, the drill head is mounted on a saddle support 51, the saddle support having a bearing face 52 parallel to a plane containing the main axis 17. The feed carriage has a swivel face 54 parallel to the plane containing the main axis 17 so as to be complementary to the saddle support. A journalling pin 56 extending between the feed carriage and saddle support to permit relative rotation therebetween about an axis 57 of the pin which extends normally from the face 54 and intersects the drill rod axis. The axis 57 is hereinafter termed "swivel axis," and the pin 56 serves as a journalling means cooperating with the feed carriage and saddle support to permit rotation of the drill head about the swivel axis. Thus it can be seen that the drill head is mounted for rotation relative to the carriage about the swivel axis which is disposed within the wheel central plane 28 and also disposed normally to and intersecting the drill rod axis. As best seen in FIG. 3, the saddle support has an arcuate slot 58 centered on the swivel axis and a locking bolt 60 extends from the saddle and through the slot and has a handle 62 for locking and unlocking the saddle support relative to the feed carriage. The arcuate slot extends through an angle 63 which is no less than a right angle to permit the drill head to be swung through a right angle between a drilling mode as shown in FIG. 3 to a rod pulling mode as will be described with reference to FIGS. 6 through 8. Ends of the slots can serve as stops for the bolt 60 to ensure the drill head is accurately positioned relative to the carriage in the two modes.

The drill head 15 has a cylindrical periphery 61 concentric with a drill head axis 64 and is carried on the feed carriage 13 by a releasable journalling means 65 that is adapted to withstand drilling forces. The means 65 is characterized by a strap 66 having an inner end 67 secured to the carriage and an outer end 68 cooperating with an over-centering locking means 70 coupled to a lever 71. The saddle has a cradle portion 73 having a bearing face 72 complementary to the periphery 61 of the drill head so as to accept the drill head against the bearing face, so that when the drill head is located therein the face 72 of the cradle portion is concentric with the drill head axis 64. Thus the drill head is located on one side thereof in the cradle portion, and is restrained in the cradle portion by the strap 66 on an opposite side of the head. Swinging the lever 71 tightens the strap 66 and clamps the drill head into the cradle portion to restrict movement of the drill head relative to the carriage. Thus the strap 66 functions similary to a band brake means 77 and provides a releasable connection of the drill head on the carriage whilst providing simultaneously the journalling means 65 for the drill head. A similar strap 78 and lever 79 are provided at an opposite end of the drill head and thus a pair of similar spaced band brake means 77 cooperate with complementary surfaces of the drill head to enclose a portion of the drill head for releasably clamping the drill head to the carriage. A handle 76 extends from the drill head for gripping by an operator to rotate the drill head and undesignated stops are provided to locate the head circumferentially relative to the saddle as will be described.

Figure 2:
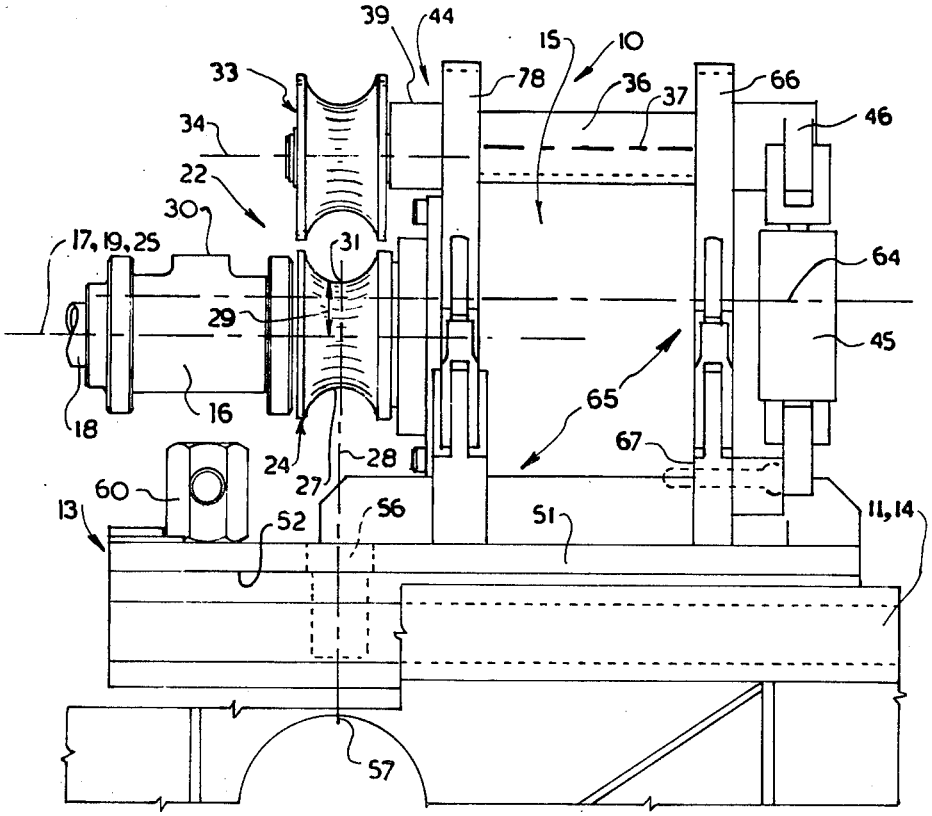
FIG. 2 is a simplified bottom plan of a drill head of the drilling mechanism fitted with the rod pulling mechanism shown in a drilling mode.

As best seen in FIGS. 2 and 4, the drill head axis 64 is disposed parallel to and between the idler wheel axis 34 and the driven wheel axis 25 and thus is displaced laterally from the main axis 17 which contrasts with some prior art drill heads. When the drill head is positioned in the drilling mode as shown in FIGS. 2 through 4, the main axis 17 is coincident with the drill rod axis 19 and the drill head axis 64 is thus spaced laterally from the drill rod axis 19 by an axis spacing 75, which spacing is dependent on radius of the drill rod and the minimum radius 29 of the drive wheel as will be explained. Thus the spacing 75 results in the main axis 17 being mounted eccentrically relative to the carriage, so that rotation of the drill head about the drill head axis through one-half revolution moves the main axis laterally to an opposite side of the drill rod axis, as will be described with reference to FIGS. 6 through 8. The spacing 75 is such that when the drill head is rotated through half a revolution about the drill head axis 64 to the rod pulling mode, the central periphery 31 of the drive wheel becomes spaced from the drill rod axis 19 by radius of the drill rod. There is a fair amount of tolerance in the spacing 75 due to flexibility of the drill rod and wear thereof, but in the rod pulling mode the periphery of the drive wheel is spaced closely adjacent the drill rod. If a drill rod having a different diameter were to be substituted, the drive wheel 24 would be changed to have a different minimum radius 29 and peripheries of the wheels 24 and 33 would likely be changed to be complementary to the drill rod. In general, the drive and idler wheels have equal minimum and maximum radii.

Thus it can be seen that the drill head is mounted for two independent movements, namely the first movement being rotation about the swivel axis 57 which moves the main axis 17 through 90°, and the second independent movement being rotation about the drill head axis 64 which moves the main axis laterally to a diametrically opposite side of the drill rod axis. Each of these movements is independent of the other and positive stops and locking means are provided for each movement to lock the drill head in the required position relative to the carriage after completion of the respective movement. The two independent movements as detailed above thus provide a swivellable mounting means to connect the drill head to the carriage or other portion of the drilling machine to permit the drill head to be positioned so that the drive wheel axis becomes generally normal to the drill rod axis, and the periphery of the drive wheel can be spaced closely adjacent the drill rod. When so spaced, the idler wheel can be moved to a position wherein oppositely disposed peripheries of the drive wheel and the idler wheel are spaced generally equally on opposite sides of the drill rod axis to accept and grip a drill rod therebetween. The movements described are performed manually for simplicity, however automatic, remote or power means can be provided. A third operation relates to actuation of the eccentric means journalling the idler wheel, which brings the idler wheels into engagement with the drill rod as will be described with reference to FIGS. 6 through 8.

Referring to FIG. 5 only, internal details of the drill head follow conventional practice and include a plurality of bearings 80 to journal a shaft carrying the rod rotating means 16, which is powered by a conventional fluid motor 82, and as previously described, the conventional water swivel connection 30 is provided to supply water to the drill rods.

Figure 6:
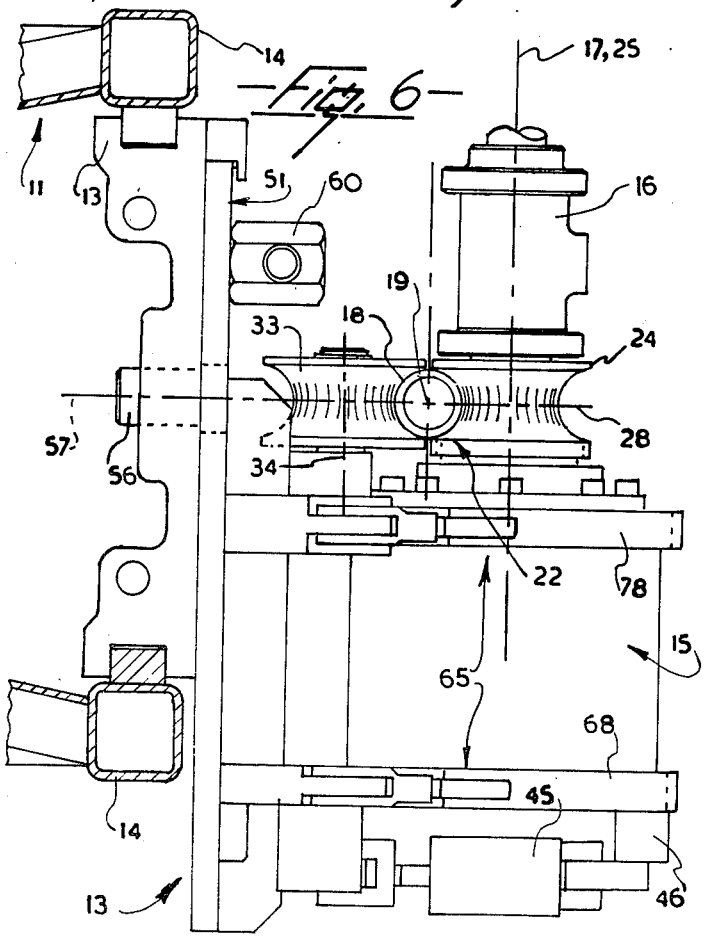
FIG. 6 is a simplified fragmented end elevation of a portion of the drilling machine with the rod pulling mechanism shown in a rod pulling mode.
Figure 7:
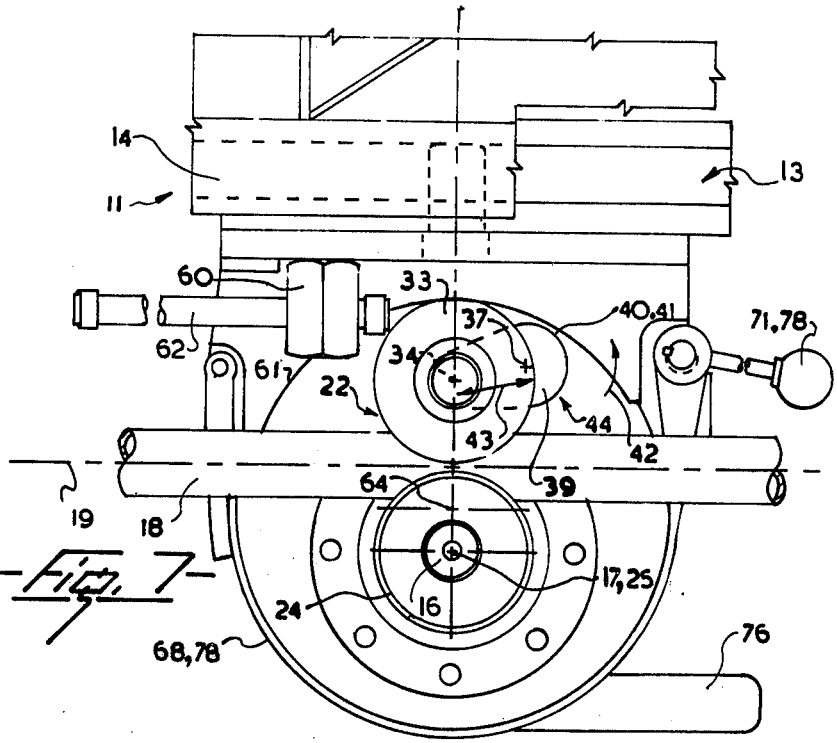
FIG. 7 is a simplified fragmented top plan of the drill head as shown in FIG. 6.
Figure 8:
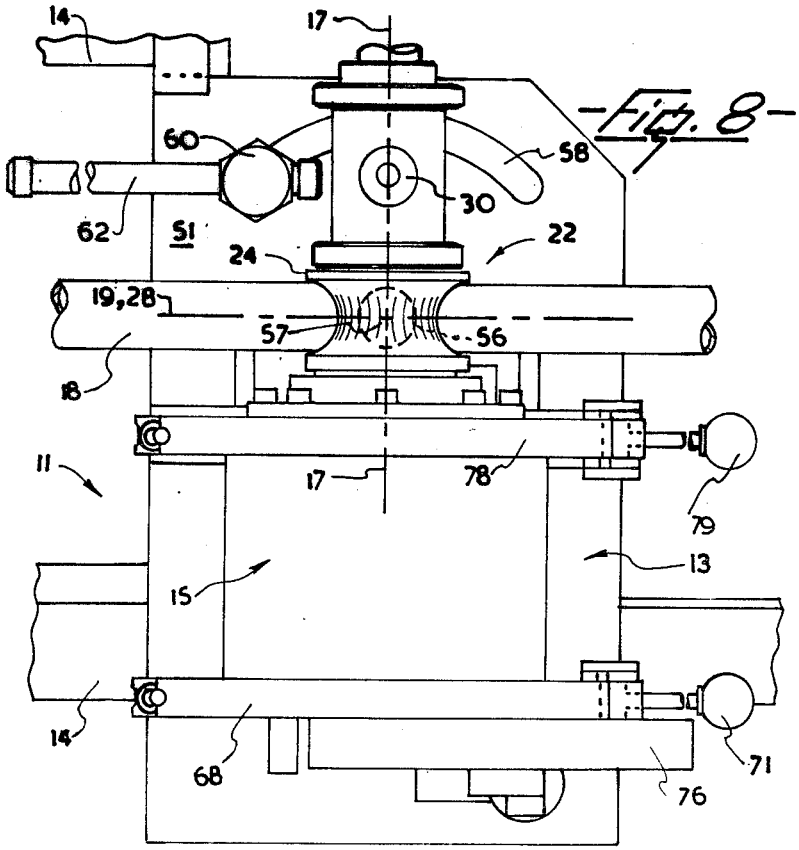
FIG. 8 is a simplified fragmented side elevation of the drill head as shown in FIG. 6.

FIGS. 6 through 8

FIGS. 6 through 8 show portions of the drill head and carriage after swivelling the drill head to the rod pulling mode. As best seen by comparing FIG. 8 with FIG. 3, after releasing the locking bolt 60 the saddle support 51 is swung through 90° until further movement is limited by the stops, so that the main axis 17 becomes disposed normally to the drill rod axis 19, after which the locking bolt is again locked to secure the drill head in position. As best seen by comparing FIG. 7 with FIG. 4, and FIG. 6 with FIG. 2, the levers 71 and 79 are first released and the handle 76 is gripped and swung to rotate the drill head about the drill head axis 64 through one-half of a revolution relative to the feed carriage until further movement is limited by the stops. This rotation swings the main axis 17 away from the feed carriage so that the idler wheel is positioned between the drive wheel and the saddle support, after which the levers 71 and 79 are swung to lock the drill head in position. In this position, the drill rod can pass adjacent to the periphery of the drive wheel 24 and between the drive wheel and idler wheel. The actuating cylinder 45 can then be actuated to swing the idler shaft 36 so that the idler wheel is brought into engagement with the drill rod to squeeze the drill rod between the idler and drive wheels. As can be seen best in FIG. 7, rotation of the means 16 causes the drive wheel 24 to rotate which pulls the drill rod in the appropriate direction with the idler wheel freewheeling and forcing the drill rod into driving engagement with the drive wheel.

OPERATION

The drilling machine is operated in a normal manner for drilling, and because the drive wheel 24 is mounted inboard of the means 16, there is a relatively small increase in "overhang" but this does not effect the drilling operation to any material extent. As seen in FIGS. 2 through 5, the idler wheel 33 is on a side of the drive wheel remote from the saddle support and thus interferes minimally with normal operation of the drill. Because the drive and idler wheels occupy a relatively small space, during normal drilling they are of little consequence and this contrasts with prior art rod pullers which can be inconvenient when drilling.

When it is required to pull drill rods from the hole, for example to change the drill bit, the drilling operation is stopped by stopping the fluid motor 82 and the rod is released from the means 16 to permit the rod to be removed from the drill head. The handle 62 is swung so as to unlock the saddle support from the carriage, and the drill head is swung through 90° about the swivel axis 57 so that the main axis 17 is disposed normally to the drill rod axis with the periphery of the drive wheel 24 disposed tangentially to the drill rod as shown in part in FIGS. 7 and 8. The locking levers 71 and 79 are then actuated to release the band brake means 77 and the handle 76 is moved manually to swing the drill head 15 through half a revolution about the drill head axis 64 so that the idler wheel is positioned between the drive wheel and the saddle support as best seen in FIG. 6.

The locking levers 71 and 79 are then locked, thus preventing rotation of the drill head relative to the saddle support and the drill rod is then inserted between the drive wheel 24 and the idler wheel 33. The actuating cylinder 45 is actuated, thus swinging the idler shaft 36 until the idler wheel contacts the drill rod, so that the drill rod is pinched between the drive wheel and idler wheel. The fluid motor is started as in normal drilling and rotated in a direction so as to pull the rods from the hole. When the drill bit has been replaced, the fluid motor is reversed to return the drill rods to the drill hole. To proceed with normal drilling, the sequence of operations as disclosed above is reversed to swivel the drill head relative to the carriage to the disposition as shown in FIGS. 2 through 5.

Alternatively, to convert the mechanism from the drilling mode to the rod pulling mode, instead of swivelling the drill head about the swivel axis as the first operation, this can be performed as the second operation after first rotating the drill head through half a revolution about the drill head axis.

ALTERNATIVES AND EQUIVALENTS

In the rod pulling mode of FIG. 8, the drill head is positioned vertically below the drill rod resulting from swinging the drill head 90° in a clockwise direction as seen in FIG. 3. In an alternative the drill head could be positioned above the drill rod in the rod pulling mode. The rod rotating means 16 is positioned at a forward end of the drill head and is of the male threaded type which engages complementary female threads at an end of the drill rod. Alternative rod rotating means could utilize the present invention, for example a manual or remote chuck which is commonly mounted on a hollow spindle. In this alternative, the drive wheel would preferably be mounted on an end of the spindle remote from the chuck. Other types of rod rotating means in which a drive wheel rotates with the rod rotating means would come within the invention.

The idler wheel is shown mounted eccentrically relative to an idler shaft in which the idler shaft has an idler shaft axis disposed parallel to and displaced from the idler wheel axis and the main axis. Other equivalent means of mounting the idler wheel are envisaged in which the idler wheel cooperates with the drill head for movement relative to the drill wheel to permit the idler wheel to be positioned so as to be essentially coplanar with the drive wheel with the idler wheel axis disposed parallel to the drive wheel axis.

Other means of swivellably mounting the drill head are envisaged in which alternative means are substituted for the band brake means 77 and the pin 56 to journal the drill head for movement relative to the carriage or other portions of the drilling machine. In all equivalent structures, the drive wheel rotates with the rod rotating means and in the rod pulling mode is positioned so that the periphery thereof is disposed tangentially to the drill rod.

I claim:

1. Rod pulling mechanism for a drill head, in which the drill head is mounted on a drilling machine, and includes a rod rotating means having a main axis and being adapted for holding and rotating a drill rod about a drill rod axis for drilling a hole when in a drilling mode, the rod pulling mechanism including:

(a) a drive wheel mounted for rotation with the rotating means about a drive wheel axis coincident with the main axis, the drive wheel having a periphery adapted for driving engagement with the drill rod, (b) an idler wheel mounted for rotation about an idler wheel axis and having a periphery adapted for engagement with the drill rod, the idler wheel cooperating with the drill head for movement relative to the drive wheel to permit the idler wheel to be positioned in a rod pulling mode so as to be essentially coplanar with with drive wheel with the idler wheel axis disposed parallel to the drive wheel axis, (c) swivellable mounting means connecting the drill head to the drilling machine to permit the drill head to be positioned in the rod pulling mode wherein the drive wheel axis is disposed generally normally to the drill rod axis, and the periphery of the drive wheel is spaced closely adjacent the drill rod, so that the idler wheel can be moved to a position wherein oppositely disposed peripheries of the drive wheel and the idler wheel are spaced generally equally on opposite sides of the drill rod axis so as to accept and to grip a drill rod therebetween.

2. A rod pulling mechanism as claimed in claim 1 in which:

(a) the drive wheel is disposed symmetrically about a wheel central plane disposed normally to the drive wheel axis, and in which the swivellable mounting means is characterized by:

(b) the drill head being mounted for rotation relative to the drilling machine about a swivel axis disposed within the wheel central plane, and also disposed normally to and intersecting the drill rod axis, so that to attain the rod pulling mode the drill head can be swung about the swivel axis to position the drive wheel symmetrically about the wheel central plane with the drive wheel axis disposed normally to the drill rod axis.

3. A rod pulling mechanism as claimed in claim 1 in which the swivellable mounting means is characterized by:

(a) the drill head being mounted for rotation relative to the drilling machine about a drill head axis disposed parallel to and displaced laterally from the main axis, so that, to attain the rod pulling mode, rotation of the drill head about the drill head axis moves the main axis laterally.

4. A rod pulling mechanism as claimed in claim 1 in which:

(a) the drive wheel is disposed symmetrically about a wheel central plane disposed normally to the drive wheel axis, and in which the drill head is adapted for mounting on a carriage and the swivellable mounting means is characterized by:

(b) the drill head being mounted for rotation relative to the carriage about a swivel axis disposed within the wheel central plane, and also disposed normally to and intersecting the drill rod axis, so that to attain the rod pulling mode the drill head can be swung about the swivel axis to position the drive wheel symmetrically about the wheel central plane with the drive wheel axis normally to the drill rod axis, and in which the swivellable mounting means is further characterized by:

(c) the drill head being mounted for rotation relative to the carriage about a drill head axis disposed parallel to and displaced laterally from the main axis, the drill head axis being disposed between the idler wheel and driven wheel axes, so that rotation of the drill head about the drill head axis moves the main axis laterally.

5. A rod pulling mechanism as claimed in claim 2 in which the swivellable mounting means is further characterized by:

(a) a saddle support mounting the drill head, the saddle support having a bearing face parallel to a plane containing the main axis, (b) the drilling machine has a feed carriage having a swivel face parallel to the plane containing the drill rod axis so as to be complementary to the saddle support, (c) journalling means cooperating with the feed carriage and the saddle support to permit rotation of the drill head about the swivel axis relative to the carriage.

6. A rod pulling mechanism as claimed in claim 3 in which the drilling machine includes a feed carriage and the swivellable mounting means is further characterized by:

(a) ring bearing means mounted on the feed carriage and enclosing a cylindrical portion of the drill head to journal the drill head for rotation about the drill head axis, (b) locking means cooperating with the ring bearing means to clamp the drill head in a particular location relative to the carriage.

7. A rod pulling mechanism as claimed in claim 6 in which:

(a) the ring bearing means includes a pair of spaced band brake means cooperating with complementary surfaces of the drill head, (b) the locking means includes an over-centering locking mechanism cooperating with the band brake means.

8. A rod pulling mechanism as claimed in claim 1 further characterized by:

(a) the drive wheel being disposed symmetrically about a wheel central plane disposed normally to the drive wheel axis, (b) an idler shaft mounting the idler wheel and cooperating with the drill head, so that in the drilling mode the idler wheel axis is parallel to the drive wheel axis, and the idler wheel is disposed symmetrically about the wheel central plane, so that to attain the rod pulling mode, movement of the idler shaft moves the idler wheel laterally relative to the driven wheel to grip a drill rod between the idler and driven wheels.

9. A rod pulling mechanism as claimed in claim 8 further characterized by:

(a) eccentric mounting means mounting the idler shaft on the drill head so that actuation of the eccentric means moves the idler wheel laterally relative to the driven wheel.

10. A rod pulling mechanism as claimed in claim 9 in which the eccentric mounting means is characterized by:

(a) the idler shaft being journalled for rotation relative to the drill head about the idler shaft axis, (b) the idler wheel axis is disposed parallel to and displaced laterally from the idler shaft axis so that the idler wheel is mounted eccentrically relative to the idler shaft, so that actuation of the eccentric mounting means rotates the idler shaft and moves the idler wheel laterally relative to the driven wheel.

* * * * *